US009564141B2

(12) United States Patent
Subasingha et al.

(10) Patent No.: US 9,564,141 B2
(45) Date of Patent: Feb. 7, 2017

(54) HARMONIC BANDWIDTH EXTENSION OF AUDIO SIGNALS

(71) Applicant: QUALCOMM Incorporated, San Diego, CA (US)

(72) Inventors: Subasingha Shaminda Subasingha, San Diego, CA (US); Venkatesh Krishnan, San Diego, CA (US); Venkatraman S. Atti, San Diego, CA (US); Vivek Rajendran, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 60 days.

(21) Appl. No.: 14/617,524

(22) Filed: Feb. 9, 2015

(65) Prior Publication Data

US 2015/0228288 A1 Aug. 13, 2015

Related U.S. Application Data

(60) Provisional application No. 61/939,585, filed on Feb. 13, 2014.

(51) Int. Cl.

| | |
|---|---|
| ***G10L 19/00*** | (2013.01) |
| ***G10L 19/02*** | (2013.01) |
| ***G10L 21/038*** | (2013.01) |
| *G10L 25/81* | (2013.01) |
| *G10L 21/0272* | (2013.01) |

(52) U.S. Cl.

CPC ..... *G10L 19/0204* (2013.01); *G10L 21/038* (2013.01); *G10L 21/0272* (2013.01); *G10L 25/81* (2013.01)

(58) Field of Classification Search

CPC ..... G10L 19/0204
USPC ..... 704/500
See application file for complete search history.

(56) References Cited

U.S. PATENT DOCUMENTS

| | | | |
|---|---|---|---|
| 8,484,036 | B2 | 7/2013 | Vos et al. |
| 2006/0277038 | A1 | 12/2006 | Vos et al. |

(Continued)

FOREIGN PATENT DOCUMENTS

| | | | |
|---|---|---|---|
| EP | 1739658 | A1 | 1/2007 |
| EP | 1947644 | A1 | 7/2008 |
| WO | 2006116025 | A1 | 11/2006 |

OTHER PUBLICATIONS

Taiwan Search Report for Taiwan Application No. TW104104441, TIPO, Date of Mailing Jan. 18, 2016, 1 page.

(Continued)

*Primary Examiner* — Shaun Roberts
(74) *Attorney, Agent, or Firm* — Toler Law Group, PC

(57) ABSTRACT

A method includes separating, at a device, an input audio signal into at least a low-band signal and a high-band signal. The low-band signal corresponds to a low-band frequency range and the high-band signal corresponds to a high-band frequency range. The method also includes selecting a non-linear processing function of a plurality of non-linear processing functions. The method further includes generating a first extended signal based on the low-band signal and the non-linear processing function. The method also includes generating at least one adjustment parameter based on the first extended signal, the high-band signal, or both.

59 Claims, 6 Drawing Sheets

(56) References Cited

U.S. PATENT DOCUMENTS

| | | | | |
|---|---|---|---|---|
| 2006/0277039 | A1* | 12/2006 | Vos | G10L 19/0208 704/219 |
| 2007/0124140 | A1* | 5/2007 | Iser | G10L 21/038 704/223 |
| 2008/0027718 | A1 | 1/2008 | Krishnan et al. | |
| 2011/0137659 | A1* | 6/2011 | Honma | G10L 21/038 704/500 |
| 2011/0295598 | A1* | 12/2011 | Yang | G10L 21/038 704/205 |

OTHER PUBLICATIONS

International Search Report and Written Opinion—PCT/US2015/015242—ISA/EPO—Apr. 30, 2015, 11 pages.

Dietz et al., "Spectral Band Replication, a novel approach in audio coding", Convention Paper 5553, Audio Engineering Society 112th Convention, May 10-13, 2002, pp. 1-8, Munich, Germany.

Krishnan et al., "EVRC-Wideband: The New 3GPP2Wideband Vocoder Standard", Acoustics, Speech and Signal Processing, 2007. ICASSP 2007. IEEE International Conference, Apr. 15-20, 2007, pp. 333-336, Honolulu, HI, United States.

* cited by examiner

HARMONIC BANDWIDTH EXTENSION OF AUDIO SIGNALS

I. CLAIM OF PRIORITY

The present application claims priority from U.S. Provisional Application No. 61/939,585, filed Feb. 13, 2014, which is entitled "HARMONIC BANDWIDTH EXTENSION OF AUDIO SIGNALS," the content of which is incorporated by reference in its entirety.

II. FIELD

The present disclosure is generally related to harmonic bandwidth extension of audio signals.

III. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet Protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player.

In traditional telephone systems (e.g., public switched telephone networks (PSTNs)), signal bandwidth is limited to the frequency range of 300 Hertz (Hz) to 3.4 kiloHertz (kHz). In wideband (WB) applications, such as cellular telephony and voice over internet protocol (VoIP), signal bandwidth may span the frequency range from 50 Hz to 7 kHz. Super wideband (SWB) coding techniques support bandwidth that extends up to around 16 kHz. Extending signal bandwidth from narrowband telephony at 3.4 kHz to SWB telephony of 16 kHz may improve the quality of signal reconstruction, intelligibility, and naturalness.

SWB coding techniques typically involve encoding and transmitting the lower frequency portion of the signal (e.g., 50 Hz to 7 kHz, also called the "low-band"). For example, the low-band may be represented using filter parameters and/or a low-band excitation signal. In order to improve coding efficiency, the higher frequency portion of the signal (e.g., 7 kHz to 16 kHz, also called the "high-band") may not be fully encoded and transmitted. A receiver may utilize signal modeling to generate a synthesized high-band signal. In some implementations, data associated with the high-band may be provided to the receiver to assist in the high-band synthesis. Such data may be referred to as "side information," and may include gain information, line spectral frequencies (LSFs, also referred to as line spectral pairs (LSPs)), etc. The side information may be generated by comparing the high-band and a synthesized high-band signal derived from the low-band. For example, the synthesized high-band signal may be based on the low-band signal and a non-linear function. A single non-linear function may be used to generate the synthesized high-band signal for low-band signals having distinct characteristics. Applying the same non-linear function for signals having distinct characteristics may result in generation of a low quality synthesized high-band signal in certain situations (e.g., speech vs. music). As a result, the synthesized high-band signal may be weakly correlated to the high-band signal.

IV. SUMMARY

Systems and methods for harmonic bandwidth extension of audio signals are disclosed. An encoder may use a low-band portion of an audio signal to generate information (e.g., adjustment parameters) used to reconstruct a high-band portion of the audio signal at a decoder. For example, the encoder may extend the low-band portion of the audio signal based on characteristics of the low-band portion. The extended low-band portion may have a greater bandwidth than the low-band portion. The encoder may determine the adjustment parameters based on the extended low-band portion and the high-band portion.

The encoder may use a selected non-linear processing function to generate the extended low-band portion. The non-linear processing function may be selected from a plurality of non-linear processing functions based on the characteristics of the low-band portion of the audio signal. The audio signal may correspond to a particular audio frame or packet. If the low-band portion indicates that the audio signal is strongly periodic (e.g., has strong harmonic components and/or corresponds to speech), the signal encoder may select a higher order non-linear function. If the low-band portion indicates that the audio signal is strongly noisy (e.g., corresponds to music), the signal encoder may select a lower order non-linear function. The encoder may determine the adjustment parameters based on a comparison of the high-band and the extended low-band portion.

A decoder may receive low-band data and the adjustment parameters from the encoder. The decoder may generate a synthesized low-band signal based on the low-band data. The decoder may generate a synthesized extended low-band portion based on the synthesized low-band signal and a selected non-linear processing function. The decoder may generate a synthesized high-band signal based on the synthesized extended low-band portion and the adjustment parameters. An output signal may be generated by combining the synthesized low-band signal and the synthesized high-band signal at the decoder.

In a particular embodiment, a method includes separating, at a device, an input audio signal into at least a low-band signal and a high-band signal. The low-band signal corresponds to a low-band frequency range and the high-band signal corresponds to a high-band frequency range. The method also includes selecting a non-linear processing function of a plurality of non-linear processing functions. The method further includes generating a first extended signal based on the low-band signal and the non-linear processing function. The method also includes generating at least one adjustment parameter based on the first extended signal, the high-band signal, or both.

In another particular embodiment, a method includes receiving, at a device, low-band data corresponding to at least a low-band signal of an input audio signal. The method also includes decoding the low-band data to generate a synthesized low-band audio signal. The method further includes selecting a non-linear processing function of a plurality of non-linear processing functions. The method also includes generating a synthesized high-band audio signal based on the synthesized low-band audio signal and the non-linear processing function.

In another particular embodiment, an apparatus includes a memory and a processor. The processor is configured to separate an input audio signal into at least a low-band signal and a high-band signal. The low-band signal corresponds to a low-band frequency range and the high-band signal corresponds to a high-band frequency range. The processor is also configured to select a non-linear processing function of a plurality of non-linear processing functions. The processor is further configured to generate a first extended signal based on the low-band signal and the non-linear processing function. The processor is also configured to generate at least one adjustment parameter based on the first extended signal, the high-band signal, or both.

In another particular embodiment, an apparatus includes a memory and a processor. The processor is configured to receive low-band data corresponding to at least a low-band signal of an input audio signal. The processor is also configured to decode the low-band data to generate a synthesized low-band audio signal. The processor is further configured to select a non-linear processing function of a plurality of non-linear processing functions. The processor is also configured to generate a synthesized high-band audio signal based on the synthesized low-band audio signal and the non-linear processing function.

In another particular embodiment, a computer-readable storage device stores instructions that, when executed by a processor, cause the processor to perform operations including separating an input audio signal into at least a low-band signal and a high-band signal. The low-band signal corresponds to a low-band frequency range and the high-band signal corresponds to a high-band frequency range. The operations also include selecting a non-linear processing function of a plurality of non-linear processing functions. The operations further include generating a first extended signal based on the low-band signal and the non-linear processing function. The operations also include generating at least one adjustment parameter based on the first extended signal, the high-band signal, or both.

In another particular embodiment, a computer-readable storage device stores instructions that, when executed by a processor, cause the processor to perform operations including receiving low-band data corresponding to at least a low-band signal of an input audio signal. The operations also include decoding the low-band data to generate a synthesized low-band audio signal. The operations further include selecting a non-linear processing function of a plurality of non-linear processing functions. The operations also include generating a synthesized high-band audio signal based on the synthesized low-band audio signal and the non-linear processing function.

Particular advantages provided by at least one of the disclosed embodiments may include improving quality of a synthesized high-band portion of an output signal. The quality of the output signal may be improved by generating the synthesized high-band portion using a non-linear function selected from multiple available non-linear processing functions based on audio characteristics of a low-band portion. The selected non-linear function may improve the correlation between a high-band portion of an input signal at an encoder and the synthesized high-band portion of the output signal at the decoder in both speech and non-speech (e.g., music) situations. Other aspects, advantages, and features of the present disclosure will become apparent after review of the application, including the following sections: Brief Description of the Drawings, Detailed Description, and the Claims.

V. BRIEF DESCRIPTION OF THE DRAWINGS

VI. DETAILED DESCRIPTION

Figure 1:
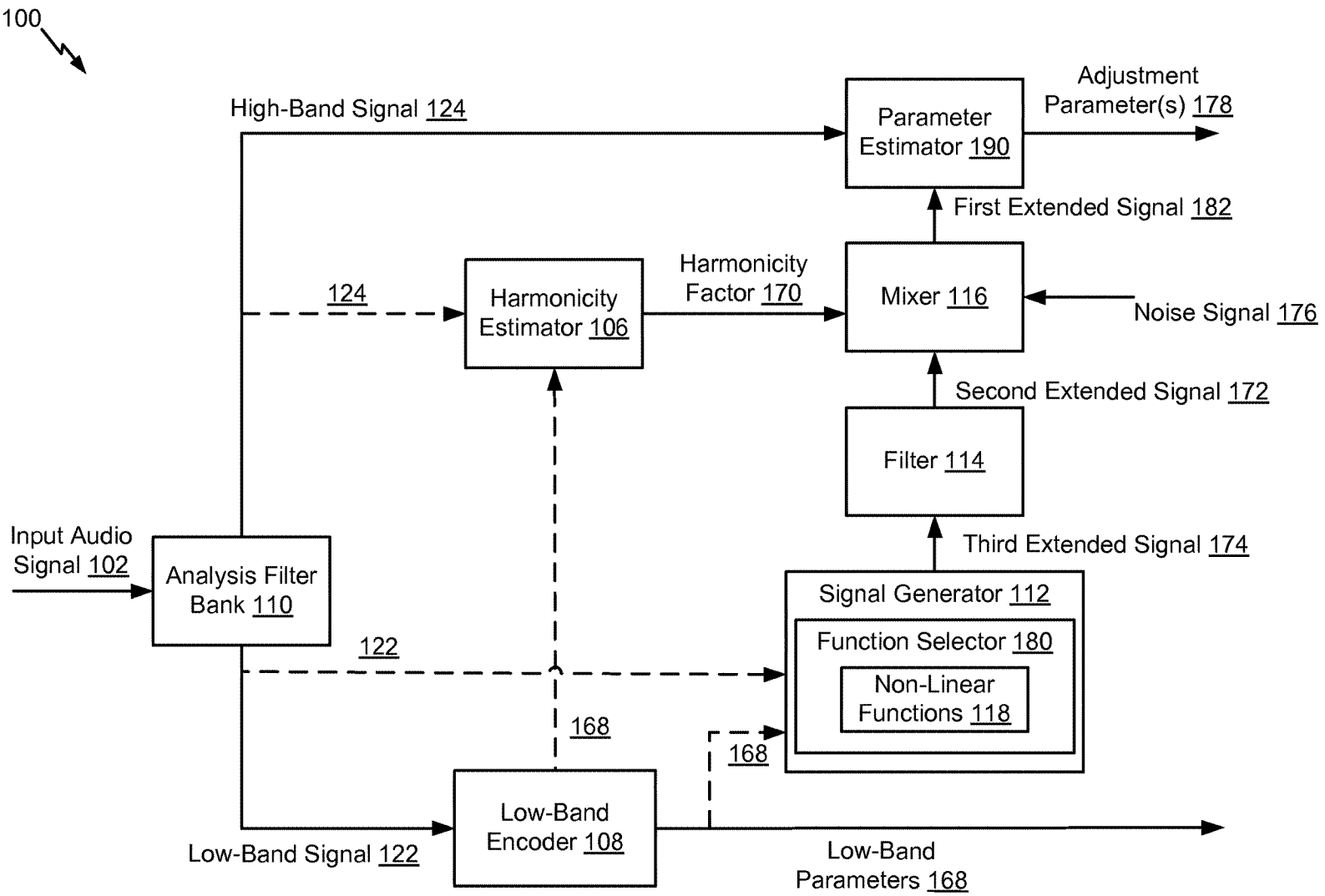
FIG. 1 is a diagram to illustrate a particular embodiment of an encoder system that is operable to perform harmonic bandwidth extension of audio signals.

Referring to FIG. 1, a diagram of a particular embodiment of an encoder system that is operable to perform harmonic bandwidth extension of audio signals is shown and is generally designated 100. In a particular embodiment, the encoder system 100 may be integrated into an encoding (or decoding) system or apparatus (e.g., in a wireless telephone or coder/decoder (CODEC)). In other embodiments, the encoder system 100 may be integrated into a set top box, a music player, a video player, an entertainment unit, a navigation device, a communications device, a personal digital assistant (PDA), a fixed location data unit, or a computer.

It should be noted that in the following description, various functions performed by the encoder system 100 of FIG. 1 are described as being performed by certain components or modules. This division of components and modules is for illustration only and not to be considered limiting. In an alternate embodiment, a function performed by a particular component or module may be divided amongst multiple components or modules. Moreover, in an alternate embodiment, two or more components or modules of FIG. 1 may be integrated into a single component or module. Each component or module illustrated in FIG. 1 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The encoder system 100 includes an analysis filter bank 110 coupled to a low-band encoder 108, a harmonicity estimator 106, a signal generator 112, and a parameter estimator 190. The signal generator 112 is coupled to a filter 114 and a mixer 116. The signal generator 112 may include a function selector 180.

During operation, the analysis filter bank 110 may receive an input audio signal 102. For example, the input audio signal 102 may be provided by a microphone or other input device. The input audio signal 102 may include speech, noise, music, or a combination thereof. The input audio signal 102 may be a super wideband (SWB) signal that includes data in the frequency range from approximately 50 hertz (Hz) to approximately 16 kilohertz (kHz). The analysis filter bank 110 may separate the input audio signal 102 into multiple portions based on frequency. For example, the analysis filter bank 110 may separate the input audio signal 102 into at least a low-band signal 122 and a high-band signal 124. In a particular embodiment, the analysis filter bank 110 may include a set of analysis filter banks. The set of analysis filter banks may separate the input audio signal 102 into at least the low-band signal 122 and the high-band signal 124. In a particular embodiment, the analysis filter bank 110 may generate more than two outputs.

In the example of FIG. 1, the low-band signal 122 and the high-band signal 124 occupy non-overlapping frequency bands. For example, the low-band signal 122 and the high-band signal 124 may occupy non-overlapping frequency bands of 50 Hz-7 kHz and 7 kHz-16 kHz, respectively. In an alternate embodiment, the low-band signal 122 and the high-band signal 124 may occupy non-overlapping frequency bands of 50 Hz-8 kHz and 8 kHz-16 kHz, respectively. In another alternate embodiment, the low-band signal 122 and the high-band signal 124 overlap (e.g., 50 Hz-8 kHz and 7 kHz-16 kHz, respectively), which may enable a low-pass filter and a high-pass filter of the analysis filter bank 110 to have a smooth rolloff, which may simplify design and reduce cost of the low-pass filter and the high-pass filter. Overlapping the low-band signal 122 and the high-band signal 124 may also enable smooth blending of low-band and high-band signals at a receiver, which may result in fewer audible artifacts.

It should be noted that although the example of FIG. 1 illustrates processing of a SWB signal, this is for illustration only and not to be considered limiting. In an alternate embodiment, the input audio signal 102 may be a wideband (WB) signal having a frequency range of approximately 50 Hz to approximately 8 kHz. In such an embodiment, the low-band signal 122 may correspond to a frequency range of approximately 50 Hz to approximately 6.4 kHz and the high-band signal 124 may correspond to a frequency range of approximately 6.4 kHz to approximately 8 kHz.

The analysis filter bank 110 may provide the low-band signal 122 to the low-band encoder 108 and may provide the high-band signal 124 to the parameter estimator 190. The parameter estimator 190 may be configured to compare a first extended signal 182 and the high-band signal 124 to generate one or more adjustment parameters 178, as described herein. The encoder system 100 may generate the first extended signal 182 based on the low-band signal 122 and a selected non-linear processing function, as described herein. The mixer 116 may be configured to generate the first extended signal 182 by modulating a second extended signal 172 using a noise signal 176. The filter 114 may be configured to generate the second extended signal 172 by filtering a third extended signal 174 from the signal generator 112.

The low-band encoder 108 may receive the low-band signal 122 from the analysis filter bank 110 and may generate low-band parameters 168. The low-band parameters 168 may indicate characteristics of the low-band signal 122. The low-band parameters 168 may include values associated with spectral tilt, pitch gain, lag, speech mode, or a combination thereof, of the low-band signal 122.

Spectral tilt may relate to a shape of a spectral envelope over a passband and may be represented by a quantized first reflection coefficient. For voiced sounds, a spectral energy may decrease with increasing frequency, such that the first reflection coefficient is negative and may approach −1. Unvoiced sounds may have a spectrum that is either flat, such that the first reflection coefficient is close to zero, or has more energy at high frequencies, such that the first reflection coefficient is positive and may approach +1.

Speech mode (also called voicing mode) may indicate whether an audio frame associated with the low-band signal 122 represents voiced or unvoiced sound. A speech mode parameter may have a binary value based on one or more measures of periodicity (e.g., zero crossings, normalized autocorrelation functions (NACFs), pitch gain, etc.) and/or voice activity for the audio frame, such as a relation between such a measure and a threshold value. In other implementations, the speech mode parameter may have one or more other states to indicate modes such as silence or background noise, or a transition between silence and voiced speech. The low-band encoder 108 may provide the low-band parameters 168 to the signal generator 112.

In a particular embodiment, the signal generator 112 may generate the low-band signal 122 based on the low-band parameters 168. For example, the signal generator 112 may include a local decoder (or a decoder emulator). The local decoder may emulate behavior of a decoder at a receiving device. For example, the local decoder may be configured to decode the low-band parameters 168 to generate the low-band signal 122. In an alternative embodiment, the signal generator 112 may receive the low-band signal 122 from the analysis filter bank 110.

The function selector 180 may select a non-linear processing function of a plurality of available non-linear processing functions 118. The plurality of available non-linear processing functions 118 may include an absolute value function, a full-wave rectification function, a half-wave rectification function, a squaring function, a cubing function, a power of four function, a clipping function, or a combination thereof.

The function selector 180 may select the non-linear processing function based on a characteristic of the low-band signal 122. To illustrate, the function selector 180 may determine a value of the characteristic based on the low-band parameters 168 or the low-band signal 122. A noise factor may indicate a periodicity of an audio frame corresponding to the low-band signal 122. For example, the noise factor may correspond to pitch gain, speech mode, spectral tilt, NACFs, zero-crossings, or a combination thereof, associated with the low-band signal 122. If the noise factor satisfies a first noise threshold, the function selector 180 may select a first non-linear processing function. For example, if the noise factor indicates that the low-band signal 122 is strongly periodic (e.g., corresponds to speech), the function selector 180 may select a high order power function (e.g., a power of four function). If the noise factor satisfies a second noise threshold, the function selector 180 may select a second non-linear processing function. For example, if the noise factor indicates that the low-band signal 122 is not very periodic or is noise-like (e.g., corresponds to music), the function selector 180 may select a low order power function (e.g., a squaring function).

In a particular embodiment, the function selector 180 may select a non-linear processing function from the plurality of available non-linear processing functions 118 on an audio frame by audio frame basis. Further, different non-linear processing functions may be selected for consecutive frames of the input audio signal 102. Thus, the function selector 180 may select a first non-linear processing function of the plurality of non-linear processing functions in response to determining that a parameter associated with a first audio frame satisfies a first condition, and may select a second non-linear processing function of the plurality of non-linear processing functions in response to determining that a parameter associated with a second audio frame satisfies a second condition. As an illustrative example, a different non-linear processing function may be applied when the input audio signal 102 corresponds to speech during a telephone call than when the input audio signal 102 corresponds to music-on-hold during the telephone call. In a particular embodiment, the parameter associated with the frame is one of a coding mode chosen to encode the low-band signal, a periodicity of the frame, an amount of non-periodic noise in the frame, and a spectral tilt corresponding to the frame.

The signal generator 112 may harmonically extend a spectrum of the low-band signal 122 to include a higher frequency range (e.g., a frequency range corresponding to the high-band signal 124). For example, the signal generator 112 may upsample the low-band signal 122. The low-band signal 122 may be upsampled to reduce aliasing upon application of the selected non-linear processing function. In a particular embodiment, the signal generator 112 may upsample the low-band signal 122 by a particular factor (e.g., 8). In a particular embodiment, the upsampling operation may include zero-stuffing the low-band signal 122. The signal generator 112 may generate the third extended signal 174 by applying the selected non-linear processing function to the upsampled signal.

The filter 114 may receive the third extended signal 174 from the signal generator 112. The filter 114 may generate the second extended signal 172 by filtering the third extended signal 174. For example, the filter 114 may downsample the third extended signal 174 such that a frequency range (e.g., 7 kHz-16 kHz) of the second extended signal 172 corresponds to the frequency range associated with the high-band signals 124. To illustrate, the filter 114 may apply a band-pass (e.g., high-pass) filtering operation to the third extended signal 174 to generate the second extended signal 172. In a particular embodiment, the filter 114 may apply a linear transformation (e.g., a discrete cosine transform (DCT)) to the third extended signal 174 and may select transform coefficients corresponding to the high frequency range (e.g., 7 kHz-16 kHz). The filter 114 may provide the second extended signal 172 to the mixer 116.

The mixer 116 may combine the second extended signal 172 and the noise signal 176. The mixer 116 may receive the noise signal 176 from a noise generator (not shown). The noise generator may be configured to produce a unit-variance white pseudorandom noise signal. In a particular embodiment, the noise signal 176 may not be white and may have a power density that varies with frequency. In a particular embodiment, the noise generator may be configured to output the noise signal 176 as a deterministic function that may be duplicated at a decoder of a receiving device. For example, the noise generator may be configured to generate the noise signal 176 as a deterministic function of the low-band parameters 168.

The mixer 116 may combine a first proportion of the noise signal 176 and a second proportion of the second extended signal 172. For example, the mixer 116 may generate the first extended signal 182 to have a ratio of harmonic energy to noise energy similar to that of the high-band signal 124. The mixer 116 may determine the first proportion and the second proportion based on a harmonicity factor 170. For example, the first proportion may be higher than the second proportion if the harmonicity factor 170 indicates that the high-band signal 124 is associated with unvoiced sound (e.g., music or noise). As another example, the second proportion may be higher than the first proportion if the harmonicity factor 170 indicates that the high-band signal 124 is associated with voiced speech. In a particular embodiment, the mixer 116 may determine the first proportion (or the second proportion) from the harmonicity factor 170 and may derive the second proportion (or the first proportion) according to an equation, such as $$(\text{the first proportion})^2+(\text{the second proportion})^2=1, \qquad \text{(Equation 1).}$$

Alternatively, the mixer 116 may select, based on the harmonicity factor 170, a corresponding pair of proportions from a plurality of pairs of proportions, where the pairs are pre-calculated to satisfy a constant-energy ratio, such as Equation (1). Values of the first proportion may range from 0.1 to 0.7 and values of the second proportion may range from 0.7 to 1.0.

The harmonicity estimator 106 may determine the harmonicity factor 170 based on an estimate of a characteristic (e.g., periodicity) of the input audio signal 102. In a particular embodiment, the harmonicity estimator 106 may generate the harmonicity factor 170 based on at least one of the high-band signal 124 and the low-band parameters 168. For example, the harmonicity estimator 106 may determine the harmonicity factor 170 based on characteristics (e.g., periodicity) of the low-band signal 122 indicated by the low-band parameters 168. To illustrate, the harmonicity estimator 106 may assign a value to the harmonicity factor 170 that is proportional to pitch gain. As another example, the harmonicity estimator 106 may determine the harmonicity factor 170 based on speech mode. To illustrate, the harmonicity factor 170 may have a first value in response to the speech mode indicating voiced audio (e.g., speech) and may have a second value in response to the speech mode indicating unvoiced audio (e.g., music).

As another example, the harmonicity estimator 106 may determine the harmonicity factor 170 based on characteristics (e.g., periodicity) of the high-band signal 124. To illustrate, the harmonicity estimator 106 may determine the harmonicity factor 170 based on a maximum value of an autocorrelation coefficient of the high-band signal 124, where the autocorrelation is performed over a search range that includes a delay of one pitch lag and does not include a delay of zero samples. In a particular embodiment, the harmonicity estimator 106 may generate high-band filter parameters corresponding to the high-band signal 124 and may determine the characteristics of the high-band signal 124 based on the high-band filter parameters.

In a particular embodiment, the harmonicity estimator 106 may determine the harmonicity factor 170 based on another indicator of periodicity (e.g., pitch gain) and a threshold value. For example, the harmonicity estimator 106 may perform an autocorrelation operation on the high-band signal 124 if the pitch gain indicated by the low-band parameters 168 satisfies a first threshold value (e.g., greater than or equal to 0.5). As another example, the harmonicity estimator 106 may perform the autocorrelation operation if the speech mode indicates a particular state (e.g., voiced speech). The harmonicity factor 170 may have a default value if the pitch gain does not satisfy the first threshold value and/or if the speech mode indicates other states.

The harmonicity estimator 106 may determine the harmonicity factor 170 based on characteristics other than, or in addition to, periodicity. For example, the harmonicity factor may have a different value for speech signals having a large pitch lag than for speech signals having a small pitch lag. In a particular embodiment, the harmonicity estimator 106 may determine the harmonicity factor 170 based on a measure of energy of the high-band signal 124 at multiples of a fundamental frequency relative to a measure of energy of the high-band signal 124 at other frequency components.

The harmonicity estimator 106 may provide the harmonicity factor 170 to the mixer 116. The mixer 116 may generate the first extended signal 182 based on the harmonicity factor 170, as described herein. The mixer 116 may provide the first extended signal 182 to the parameter estimator 190.

The parameter estimator 190 may generate the adjustment parameters 178 based on at least one of the high-band signal 124 or the first extended signal 182. For example, the parameter estimator 190 may generate the adjustment parameters 178 based on a relation between the high-band signal 124 and the first extended signal 182, such as difference or ratio between energies of the two signals. In a particular embodiment, the adjustment parameters 178 may correspond to one or more gain adjustment parameters indicating the difference or ratio between the energies of the two signals. In an alternative embodiment, the adjustment parameters 178 may correspond to a quantized index of the gain adjustment parameters. In a particular embodiment, the adjustment parameters 178 may include high-band parameters indicating characteristics of the high-band signal 124. In a particular embodiment, the parameter estimator 190 may generate the adjustment parameters 178 based on the high-band signal 124 and not based on the first extended signal 182.

The parameter estimator 190 may provide the adjustment parameters 178 and the low-band encoder 108 may provide the low-band parameters 168 to a multiplexer (MUX). The MUX may multiplex the adjustment parameters 178 and the low-band parameters 168 to generate an output bit stream. The output bit stream may represent an encoded audio signal corresponding to the input audio signal 102. For example, the MUX may be configured to insert the adjustment parameters 178 into an encoded version of the input audio signal 102 to enable gain adjustment during reproduction of the input audio signal 102. The output bit stream may be transmitted (e.g., over a wired, wireless, or optical channel) by a transmitter and/or stored. At a receiving device, reverse operations may be performed by a demultiplexer (DEMUX), a low-band decoder, a high-band decoder, and a filter bank to generate an audio signal (e.g., a reconstructed version of the input audio signal 102 that is provided to a speaker or other output device), as described with reference to FIG. 2. In a particular embodiment, the harmonicity estimator 106 may provide the harmonicity factor 170 to the MUX and the MUX may include the harmonicity factor 170 in the output bit stream.

The encoder system 100 generates a synthesized high-band signal (e.g., the first extended signal 182), at an encoder, using a non-linear processing function selected based on characteristics of the low-band signal 122. Using the selected non-linear processing function may increase the correlation between the synthesized high-band signal and the high-band signal 124 in both voiced and unvoiced cases.

Figure 2:
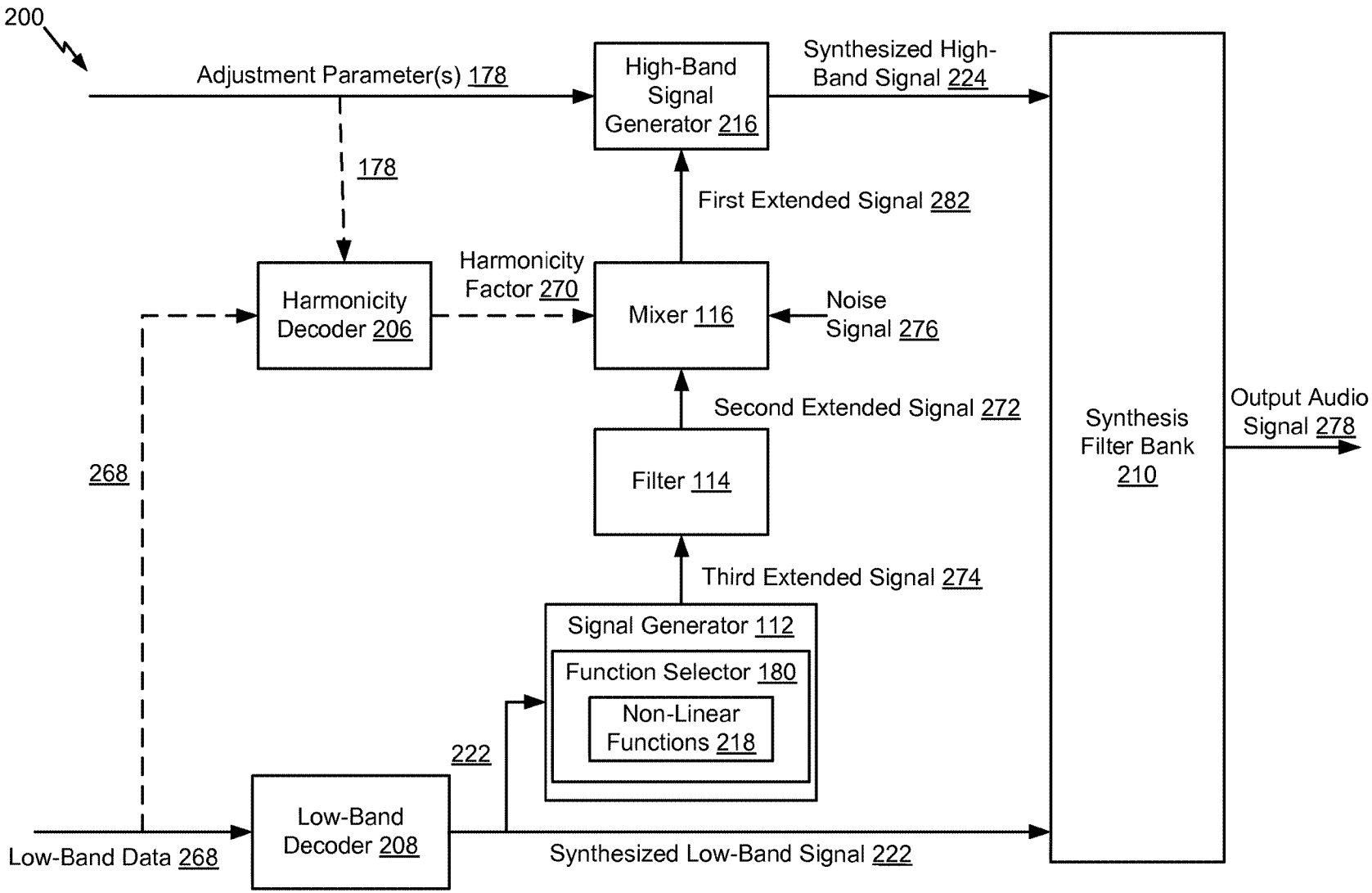
FIG. 2 is a diagram of another particular embodiment of a decoder system that is operable to perform harmonic bandwidth extension of audio signals.

Referring to FIG. 2, a particular embodiment of a decoder system that is operable to perform harmonic bandwidth extension of audio signals is shown and is generally designated 200. The encoder system 100 and the decoder system 200 may be included in a single device or in separate devices.

In a particular embodiment, the decoder system 200 may be integrated into an encoding (or decoding) system or apparatus (e.g., in a wireless telephone or coder/decoder (CODEC)). In other embodiments, the decoder system 200 may be integrated into a set top box, a music player, a video player, an entertainment unit, a navigation device, a communications device, a personal digital assistant (PDA), a fixed location data unit, or a computer.

It should be noted that in the following description, various functions performed by the decoder system 200 of FIG. 2 are described as being performed by certain components or modules. This division of components and modules is for illustration only and not to be considered limiting. In an alternate embodiment, a function performed by a particular component or module may be divided amongst multiple components or modules. Moreover, in an alternate embodiment, two or more components or modules of FIG. 2 may be integrated into a single component or module. Each component or module illustrated in FIG. 2 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The decoder system 200 includes a low-band decoder 208 coupled to the signal generator 112, the filter 114, the mixer 116, a high-band signal generator 216, and a synthesis filter bank 210.

During operation, the low-band decoder 208 may receive low-band data 268. The low-band data 268 may correspond to an output bit stream generated by the encoder system 100 of FIG. 1. For example, a receiver at the decoder system 200 may receive (e.g., over a wired, wireless, or optical channel) an input bit stream. The input bit stream may correspond to an output bit stream generated by the encoder system 100. The receiver may provide the input bit stream to a demultiplexer (DEMUX). The DEMUX may generate the low-band data 268 and the adjustment parameters from the input bit stream. In a particular embodiment, the DEMUX may extract a harmonicity factor from the input bit stream. The DEMUX may provide the low-band data 268 to the low-band decoder 208.

The low-band decoder 208 may extract low-band parameters from the low-band data 268. The low-band parameters may correspond to the low-band parameters 168 of FIG. 1. The low-band decoder 208 may generate a synthesized low-band signal 222 based on the low-band parameters. The synthesized low-band signal 222 may approximate the low-band signal 122 of FIG. 1.

The signal generator 112 may receive the synthesized low-band signal 222 from the low-band decoder 208. The signal generator 112 may generate a third extended signal 274 based on the synthesized low-band signal 222, as described with reference to FIG. 1. For example, the function selector 180 may select a non-linear processing function from a plurality of available non-linear processing functions 218 based on the synthesized low-band signal 222. The signal generator may extend the synthesized low-band signal 222 and may apply the selected non-linear processing function to generate the third extended signal 274. The third extended signal 274 may approximate the third extended signal 174 of FIG. 1. In a particular embodiment, the function selector 180 selects a non-linear processing function based on a received parameter. For example, the decoder system 200 may receive a parameter that identifies (e.g., by index) a particular non-linear processing function that was applied by an encoder system (e.g., the encoder system 100) to encode a particular audio frame or sequence of audio frames. Such a parameter may be received for each frame or when the non-linear processing function to be used changes.

The filter 114 may generate a second extended signal 272 by filtering the third extended signal 274, as described with reference to FIG. 1. The second extended signal 272 may approximate the second extended signal 172 of FIG. 1.

The mixer 116 may generate the first extended signal 282 by combining a noise signal 276 and the second extended signal 272 based on a harmonicity factor 270, as described with reference to FIG. 2. The noise signal 276 may approximate the noise signal 176 of FIG. 1 and the first extended signal 282 may approximate the first extended signal 182 of FIG. 1.

The harmonicity decoder 206 may receive the low-band data 268, the adjustment parameters 178, a received harmonicity factor (e.g., parameter), or a combination thereof. For example, the harmonicity decoder 206 may receive the low-band data 268, the adjustment parameters 178, the received harmonicity factor, or a combination thereof, from a DEMUX of the decoder system 200. The harmonicity decoder 206 may generate the harmonicity factor 270 based on the low-band data 268, the adjustment parameters 178, the received harmonicity factor, or a combination thereof. For example, the harmonicity decoder 206 may extract low-band parameters from the low-band data 268. As another example, the harmonicity decoder 206 may extract high-band parameters from the adjustment parameters 178. The harmonicity decoder 206 may generate a calculated harmonicity factor based on the low-band parameters, the high-band parameters, or both, as described with reference to FIG. 1.

The harmonicity decoder 206 may set the harmonicity factor 270 to be the calculated harmonicity factor or the received harmonicity factor. In a particular embodiment, the harmonicity decoder 206 may set the harmonicity factor 270 to the calculated harmonicity factor in response to detecting an error in the received harmonicity factor. The harmonicity decoder 206 may detect the error in response to determining that a difference between the received harmonicity factor and the calculated harmonicity factor satisfies a particular threshold value. The harmonicity decoder 206 may provide the harmonicity factor 270 to the mixer 116. The mixer 116 may provide the first extended signal 282 to the high-band signal generator 216.

The high-band signal generator 216 may generate a synthesized high-band signal 224 based on at least one of the adjustment parameters 178 and the first extended signal 282. For example, the high-band signal generator 216 may apply the adjustment parameters 178 to the first extended signal 282 to generate the synthesized high-band signal 224. To illustrate, the high-band signal generator 216 may scale the first extended signal 282 by a factor that is associated with at least one of the adjustment parameters 178. In a particular embodiment, one or more of the adjustment parameters 178 may correspond to gain adjustment parameters. The high-band signal generator 216 may apply the gain adjustment parameters to the first extended signal 282 to generate the synthesized high-band signal 224. The synthesis filter bank 210 may receive the synthesized high-band signal 224 and the synthesized low-band signal 222. The output audio signal 278 may be provided to a speaker (or other output device) by the synthesis filter bank 210 and/or stored.

The decoder system 200 may enable a synthesized high-band signal to be generated at a decoder using a non-linear processing function selected based on low-band parameters indicating characteristics of a low-band portion of an input signal received at an encoder. Using the selected non-linear processing function to generate the synthesized high-band signal may improve the correlation between the synthesized high-band signal and a high-band portion of the input signal in both voiced and unvoiced cases.

Figure 3:
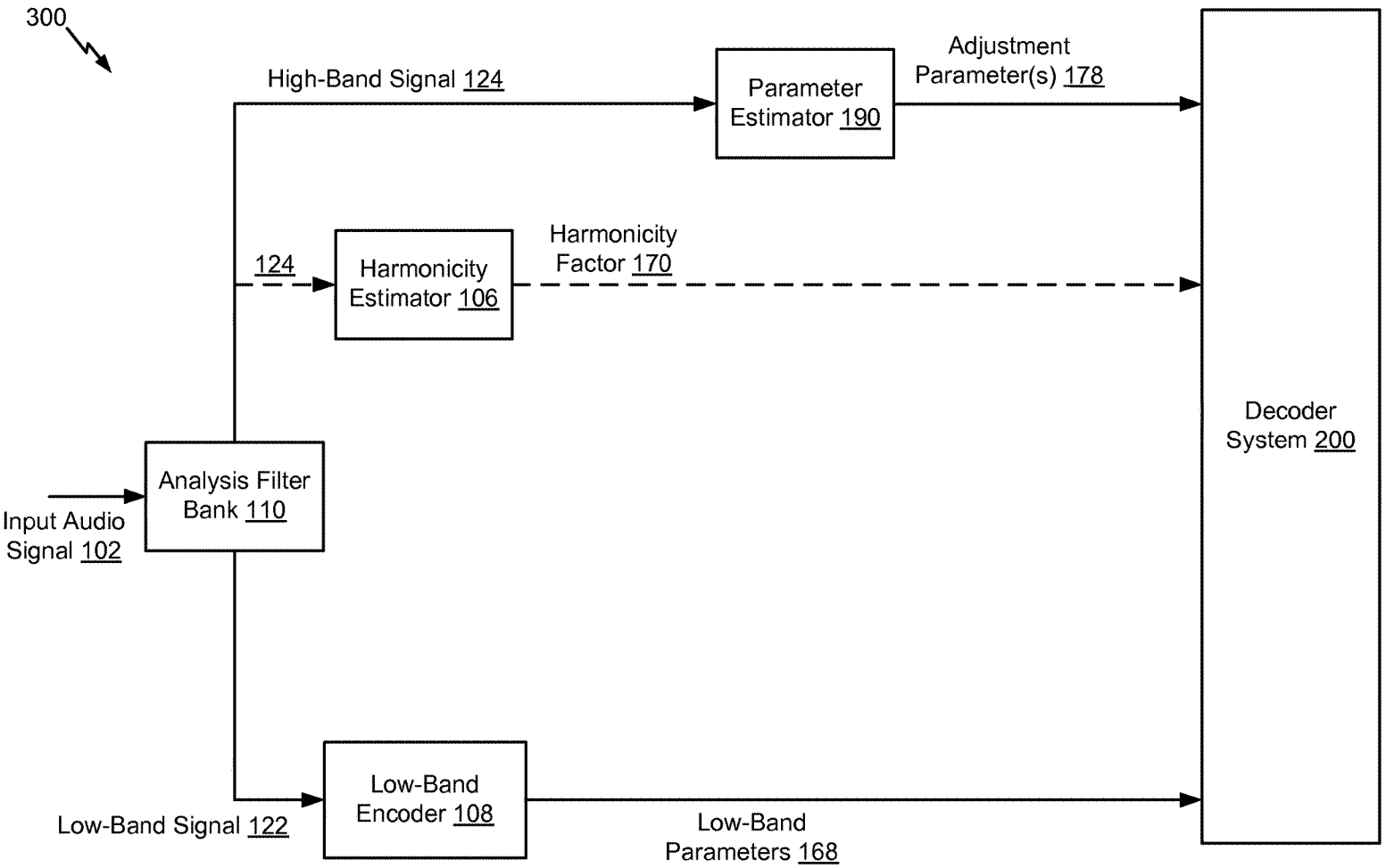
FIG. 3 is a diagram of another particular embodiment of a system that is operable to perform harmonic bandwidth extension of audio signals.

Referring to FIG. 3, a particular embodiment of a system that is operable to perform harmonic bandwidth extension of audio signals is shown and is generally designated 300.

In a particular embodiment, the system 300 (or portions thereof) may be integrated into an encoding (or decoding) system or apparatus (e.g., in a wireless telephone or coder/decoder (CODEC)). In other embodiments, the system 300 (or portions thereof) may be integrated into a set top box, a music player, a video player, an entertainment unit, a navigation device, a communications device, a personal digital assistant (PDA), a fixed location data unit, or a computer.

It should be noted that in the following description, various functions performed by the system 300 of FIG. 3 are described as being performed by certain components or modules. This division of components and modules is for illustration only and not to be considered limiting. In an alternate embodiment, a function performed by a particular component or module may be divided amongst multiple components or modules. Moreover, in an alternate embodiment, two or more components or modules of FIG. 3 may be integrated into a single component or module. Each component or module illustrated in FIG. 3 may be implemented using hardware (e.g., a field-programmable gate array (FPGA) device, an application-specific integrated circuit (ASIC), a digital signal processor (DSP), a controller, etc.), software (e.g., instructions executable by a processor), or any combination thereof.

The system 300 includes the analysis filter bank 110, the low-band encoder 108, the harmonicity estimator 106, the parameter estimator 190, and the decoder system 200.

During operation, the analysis filter bank 110 may receive the input audio signal 102. The analysis filter bank 110 may separate the input audio signal 102 into at least the low-band signal 122 and the high-band signal 124.

The low-band encoder 108 may receive the low-band signal 122 from the analysis filter bank 110. The low-band encoder 108 may determine low-band parameters 168 based on the low-band signal 122, as described with reference to FIG. 1. The low-band encoder 108 may provide the low-band parameters 168 to the decoder system 200.

The harmonicity estimator 106 may receive the high-band signal 124 and may generate the harmonicity factor 170 based on the high-band signal 124. For example, the harmonicity estimator 106 may generate the harmonicity factor 170 based on high-band parameters indicating characteristics of the high-band signal 124, as described with reference to FIG. 1. The harmonicity estimator 106 may provide the harmonicity factor 170 to the decoder system 200.

The parameter estimator 190 may generate the adjustment parameters 178 based on the high-band signal 124. For example, the adjustment parameters 178 may correspond to high-band parameters indicating characteristics of the high-band signal 124. The parameter estimator 190 may provide the adjustment parameters 178 to the decoder system 200. The decoder system 200 may generate the synthesized high-band signal 224 based on the adjustment parameters 178, the low-band parameters 168, the harmonicity factor 170, or a combination thereof, as described with reference to FIG. 2.

The system 300 enables a synthesized high-band signal to be generated at a decoder using a non-linear processing function selected based on characteristics of a synthesized low-band signal. The system 300 may generate the adjustment parameters 178 based on the high-band signal 124 and not based on an extended version of the low-band signal. In a particular embodiment, the system 300 may generate the adjustment parameters 178 faster than the encoder system 100 by saving processing time to extend the input audio signal 102 and mix the extended signal with a noise signal.

Figure 4:
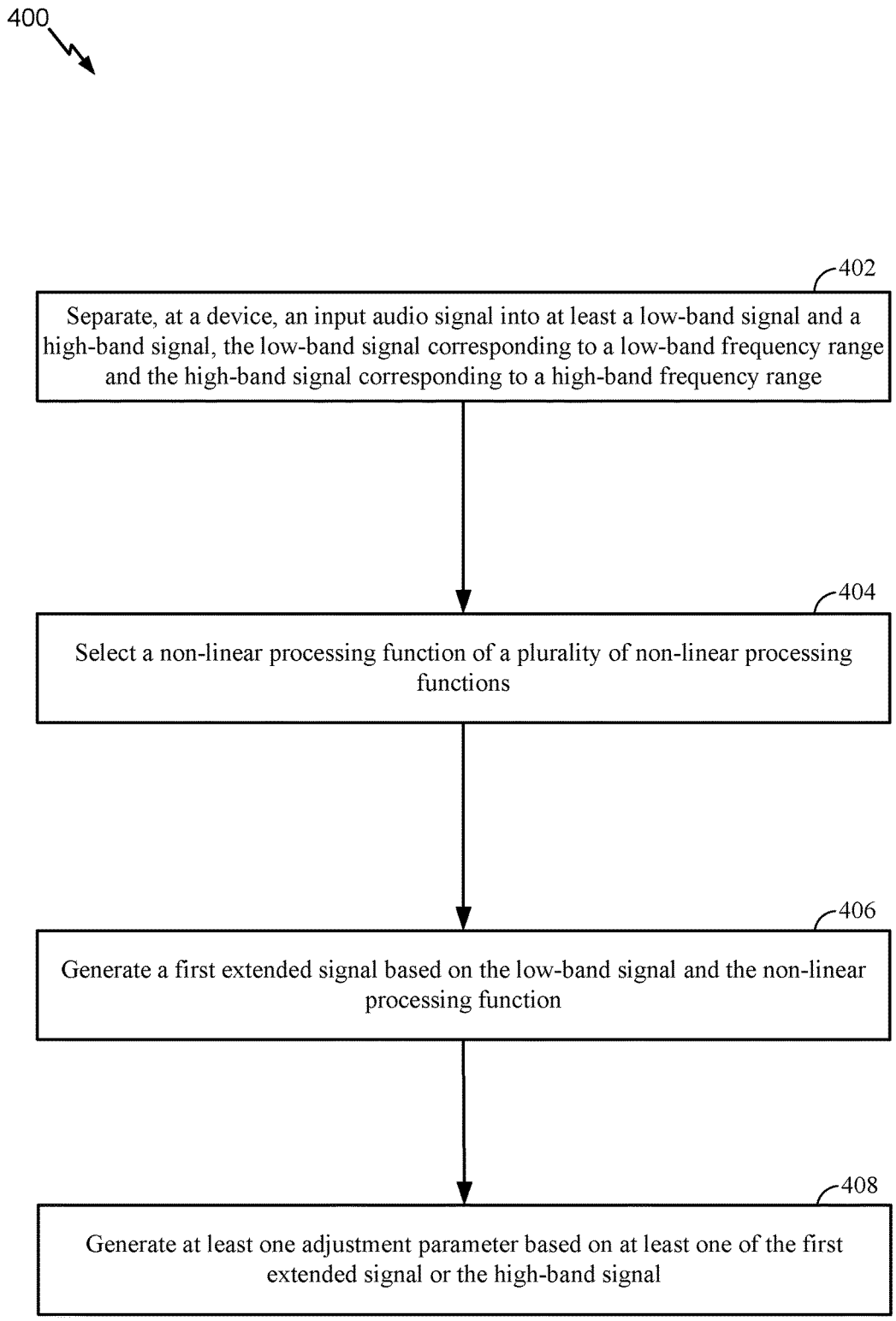
FIG. 4 is a flowchart to illustrate a particular embodiment of a method of performing harmonic bandwidth extension of audio signals.

Referring to FIG. 4, a flowchart of a particular embodiment of a method of performing harmonic bandwidth extension of audio signals is shown and is generally designated 400. The method 400 may be performed by the encoder system 100 of FIG. 1.

The method 400 may include separating, at a device, an input audio signal into at least a low-band signal and a high-band signal, at 402. The low-band signal may correspond to a low-band frequency range and the high-band signal may correspond to a high-band frequency range. For example, the analysis filter bank 110 of FIG. 1 may separate the input audio signal 102 into at least the low-band signal 122 and the high-band signal 124, as described with reference to FIG. 1. The low-band signal 122 may correspond to a low-band frequency range (e.g., 50 hertz (Hz)-7 kilohertz (kHz)) and the high-band signal 124 may correspond to a high-band frequency range (e.g., 7 kHz-16 kHz).

The method 400 may also include selecting a non-linear processing function of a plurality of non-linear processing functions, at 404. For example, the function selector 180 of FIG. 1 may select a particular non-linear processing function of the plurality of available non-linear processing functions 118, as described with reference to FIG. 1.

The method 400 may further include generating a first extended signal based on the low-band signal and the non-linear processing function, at 406. For example, the mixer 116 of FIG. 1 may generate the first extended signal 182 based on the low-band signal 122 and the selected non-linear processing function, as described with reference to FIG. 1.

The method 400 may also include generating at least one adjustment parameter based on at least one of the first extended signal or the high-band signal, at 408. For example, the parameter estimator 190 may generate the adjustment parameters 178 based on at least one of the first extended signal 182 or the high-band signal 124, as described with reference to FIG. 1.

The method 400 may enable generating a synthesized high-band signal (e.g., the first extended signal 182), at an encoder, using a non-linear processing function selected based on characteristics of the low-band signal 122. Using the selected non-linear processing function may increase the correlation between the synthesized high-band signal and the high-band signal 124 in both voiced and unvoiced cases.

In a particular embodiment, the method 400 of FIG. 4 may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 400 of FIG. 4 can be performed by a processor that executes instructions, as described with respect to FIG. 6.

Figure 5:
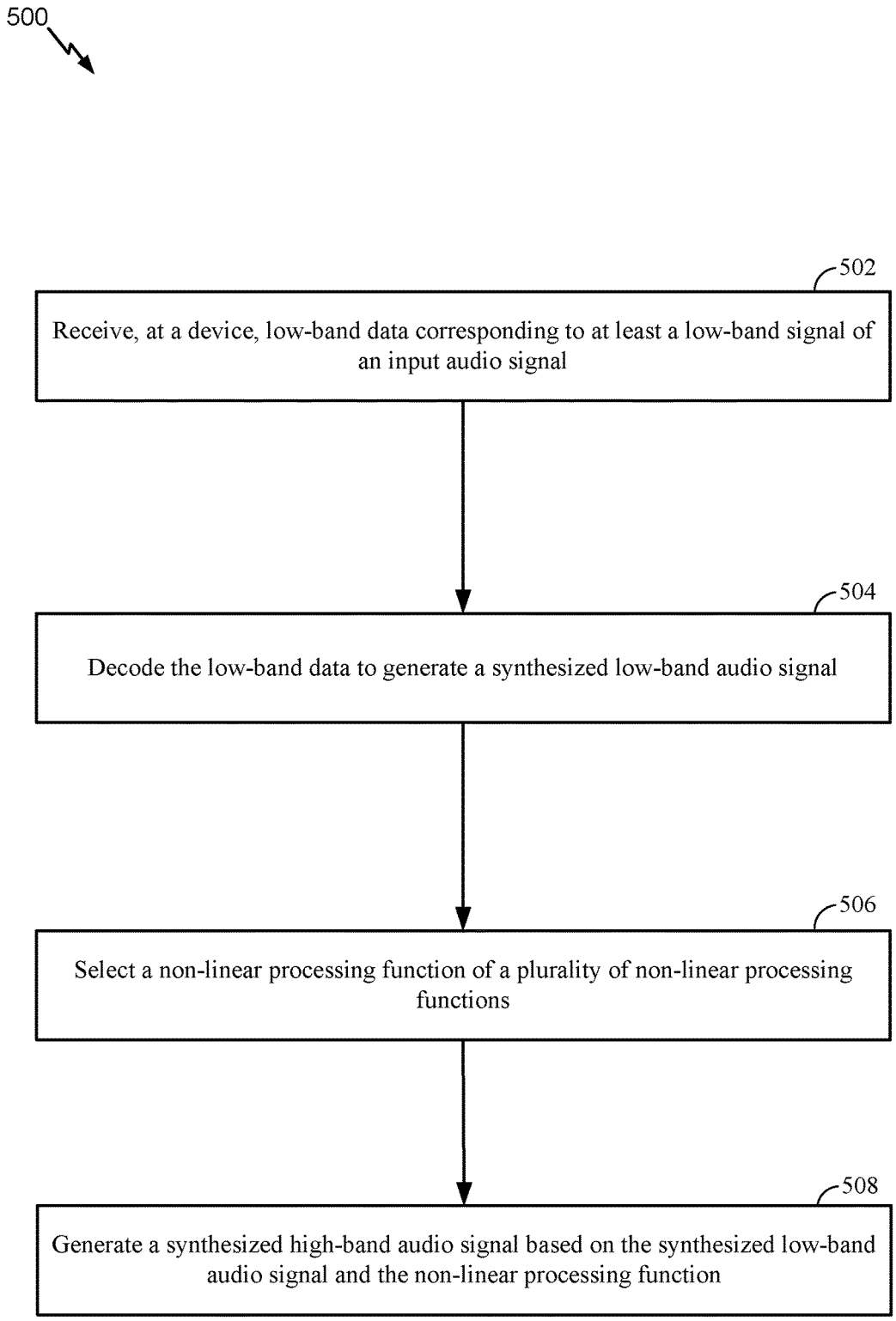
FIG. 5 is a flowchart to illustrate another particular embodiment of a method of performing harmonic bandwidth extension of audio signals.

Referring to FIG. 5, a flowchart of a particular embodiment of a method of performing harmonic bandwidth extension of audio signals is shown and is generally designated 500. The method 500 may be performed by the decoder system 200 of FIG. 2.

The method 500 may include receiving, at a device, low-band data corresponding to at least a low-band signal of an input audio signal, at 502. For example, a DEMUX of the decoder system 200 may receive an input bit stream via a receiver, as described with reference to FIG. 2. As another example, the low-band decoder 208 may receive the low-band data 268, as described with reference to FIG. 2.

The method 500 may also include decoding the low-band data to generate a synthesized low-band audio signal, at 504. For example, the low-band decoder 208 may decode the low-band data 268 to generate the synthesized low-band signal 222, as described with reference to FIG. 2.

The method 500 may further include selecting a non-linear processing function of a plurality of non-linear processing functions, at 506. For example, the function selector 180 may select a particular non-linear processing function of the plurality of available non-linear processing functions 118, as described with reference to FIG. 2.

The method 500 may also include generating a synthesized high-band audio signal based on the synthesized low-band audio signal and the non-linear processing function, at 508. For example, the high-band signal generator 216 may generate the synthesized high-band signal 224 based on the synthesized low-band signal 222 and the selected non-linear processing function, as described with reference to FIG. 2.

The method 500 may enable a synthesized high-band signal to be generated at a decoder using a non-linear processing function selected based on low-band parameters indicating characteristics of a low-band portion of an input signal received at an encoder. Using the selected non-linear processing function to generate the synthesized high-band signal may improve the correlation between the synthesized high-band signal and a high-band portion of the input signal in both voiced and unvoiced cases.

In a particular embodiment, the method 500 of FIG. 5 may be implemented via hardware (e.g., a field-programmable gate array (FPGA) device, an application-specific integrated circuit (ASIC), etc.) of a processing unit, such as a central processing unit (CPU), a digital signal processor (DSP), or a controller, via a firmware device, or any combination thereof. As an example, the method 500 of FIG. 5 can be performed by a processor that executes instructions, as described with respect to FIG. 6.

Figure 6:
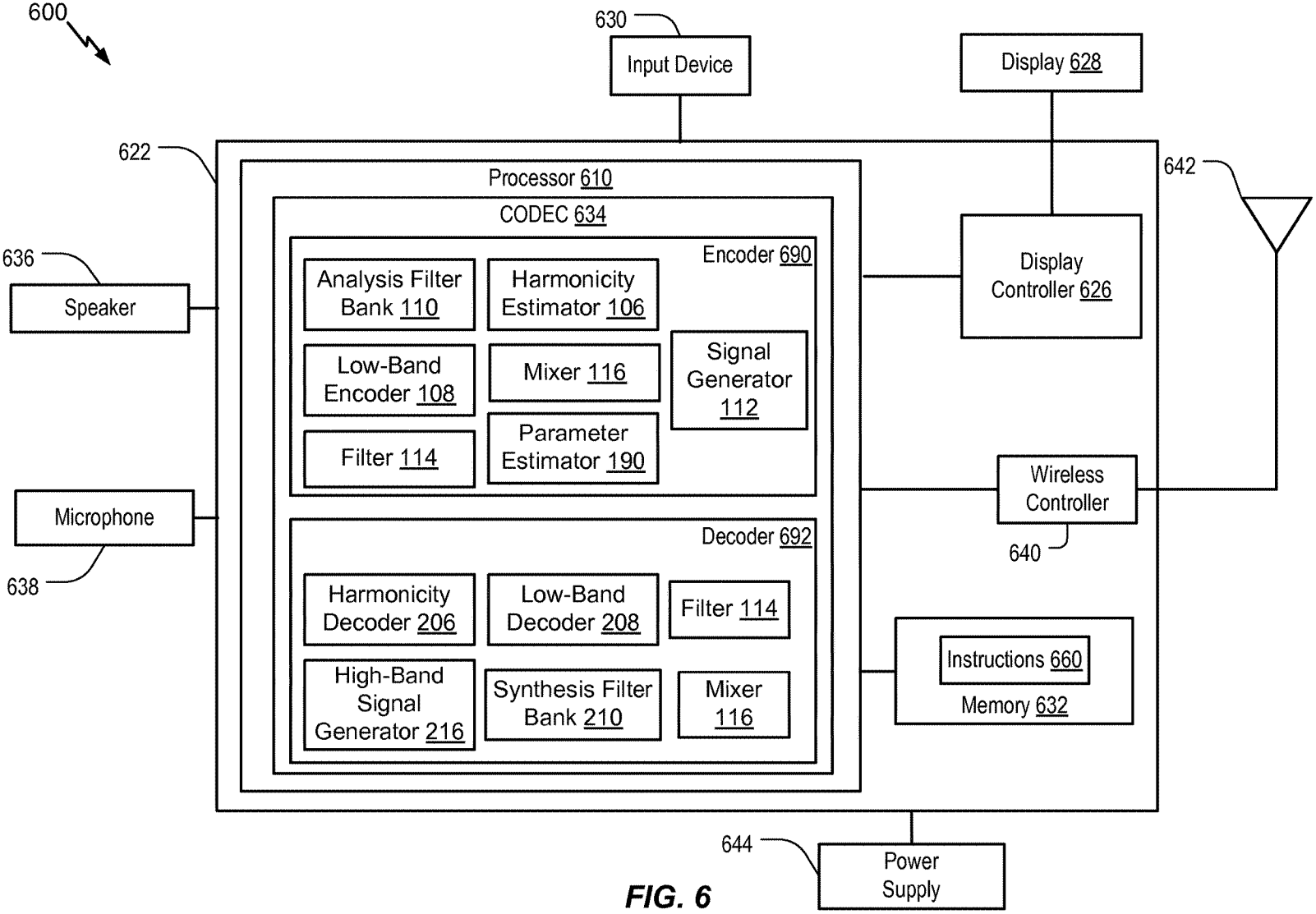
FIG. 6 is a block diagram of a wireless device operable to perform signal processing operations in accordance with the systems and methods of FIGS. 1-5.

Referring to FIG. 6, a block diagram of a particular illustrative embodiment of a wireless communication device is depicted and generally designated 600. The device 600 includes a processor 610 (e.g., a central processing unit (CPU), a digital signal processor (DSP), etc.) coupled to a memory 632. The memory 632 may include instructions 660 executable by the processor 610. The processor 610 may also include a coder/decoder (CODEC) 634, as shown. The CODEC 634 may perform, and/or the instructions 660 may be executable by the processor 610 to perform, methods and processes disclosed herein, such as the method 400 of FIG. 4, the method 500 of FIG. 5, or both.

The CODEC 634 may include an encoder 690 and a decoder 692. The encoder 690 may include one or more of the analysis filter bank 110, the harmonicity estimator 106, the low-band encoder 108, the mixer 116, the signal generator 112, the filter 114, and the parameter estimator 190, as shown. The decoder 692 may include one or more of the synthesis filter bank 210, the harmonicity decoder 206, the low-band decoder 208, the high-band signal generator 216, the mixer 116, and the filter 114, as shown. In alternate embodiments, the encoder 690 and the decoder 692 may reside within or part of multiple processors. For example, the device 600 may include multiple processors, such as a DSP and an application processor, and the encoder 690 and decoder 692, or components thereof, may be included in some or all of the multiple processors.

The analysis filter bank 110, the harmonicity estimator 106, the low-band encoder 108, the mixer 116, the signal generator 112, the filter 114, the parameter estimator 190, the synthesis filter bank 210, the harmonicity decoder 206, the low-band decoder 208, the high-band signal generator 216, or a combination thereof, may be implemented via dedicated hardware (e.g., circuitry), by a processor executing instructions to perform one or more tasks, or a combination thereof. As an example, such instructions may be stored in a memory device, such as a random access memory (RAM), magnetoresistive random access memory (MRAM), spin-torque transfer MRAM (STT-MRAM), flash memory, read-only memory (ROM), programmable read-only memory (PROM), solid state memory, erasable programmable read-only memory (EPROM), electrically erasable programmable read-only memory (EEPROM), registers, hard disk, a removable disk, or a compact disc read-only memory (CD-ROM).

FIG. 6 also shows a display controller 626 that is coupled to the processor 610 and to a display 628. A speaker 636 and a microphone 638 can be coupled to the device 600. For example, the microphone 638 may generate the input audio signal 102 of FIG. 1, and the device 600 may generate an output bit stream for transmission to a receiver based on the input audio signal 102, as described with reference to FIG. 1. For example, the output bit stream may be transmitted by a transmitter via the processor 610, a wireless controller 640, and an antenna 642. As another example, the speaker 636 may be used to output a signal reconstructed by the device 600 from an input bit stream received by a receiver (e.g., via the wireless controller 640 and the antenna 642), as described with reference to FIG. 2.

In a particular embodiment, the processor 610, the display controller 626, the memory 632, and the wireless controller 640 are included in a system-in-package or system-on-chip device (e.g., a mobile station modem (MSM)) 622. In a particular embodiment, an input device 630, such as a touchscreen and/or keypad, and a power supply 644 are coupled to the system-on-chip device 622. Moreover, in a particular embodiment, as illustrated in FIG. 6, the display 628, the input device 630, the speaker 636, the microphone 638, the antenna 642, and the power supply 644 are external to the system-on-chip device 622. Each of the display 628, the input device 630, the speaker 636, the microphone 638, the antenna 642, and the power supply 644 can be coupled to a component of the system-on-chip device 622, such as an interface or a controller.

In conjunction with the described embodiments, a first apparatus may include means for separating an input audio signal into at least a low-band signal and a high-band signal, such as the analysis filter bank 110, one or more other devices or circuits configured to separate an audio signal, or any combination thereof. The low-band signal may correspond to a low-band frequency range and the high-band signal may correspond to a high-band frequency range. The apparatus may also include means for selecting a non-linear processing function of a plurality of non-linear processing functions, such as the function selector 180, one or more other devices or circuits configured to select a non-linear processing function from a plurality of non-linear processing functions, or any combination thereof. The apparatus may further include first means for generating a first extended signal based on the low-band signal and the non-linear processing function, such as the mixer 116, one or more other devices or circuits configured to generate a signal based on a low-band signal and a non-linear processing function, or any combination thereof. The apparatus may also include second means for generating at least one adjustment parameter based on the first extended signal, the high-band signal, or both, such as the parameter estimator 190, one or more other devices or circuits configured to generate at least one adjustment parameter based on an extended signal and/or a high-band signal, or any combination thereof.

In conjunction with the described embodiments, a second apparatus may include means for receiving low-band data corresponding to at least a low-band signal of an input audio signal, such as a component (e.g., a receiver) of or coupled to the decoder system 200, one or more other devices or circuits configured to receive low-band data corresponding to a low-band signal of an input audio signal, or any combination thereof. The apparatus may also include means for decoding the low-band data to generate a synthesized low-band audio signal, such as the low-band decoder 208, one or more other devices or circuits configured to decode low-band data to generate a synthesized low-band audio signal, or any combination thereof. The apparatus may further include means for selecting a non-linear processing function of a plurality of non-linear processing functions, such as the function selector 180, one or more other devices or circuits configured to select a non-linear processing function of a plurality of non-linear processing functions, or any combination thereof. The apparatus may also include means for generating a synthesized high-band audio signal based on the synthesized low-band audio signal and the non-linear processing function, such as the high-band signal generator 216, one or more other devices or circuits configured to generate a synthesized high-band audio signal based on a synthesized low-band audio signal and a non-linear processing function, or any combination thereof.

Those of skill would further appreciate that the various illustrative logical blocks, configurations, modules, circuits, and algorithm steps described in connection with the embodiments disclosed herein may be implemented as electronic hardware, computer software executed by a processing device such as a hardware processor, or combinations of both. Various illustrative components, blocks, configurations, modules, circuits, and steps have been described above generally in terms of their functionality. Whether such functionality is implemented as hardware or executable software depends upon the particular application and design constraints imposed on the overall system. Skilled artisans may implement the described functionality in varying ways for each particular application, such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in a memory device, such as random access memory (RAM), magnetoresistive random access memory (MRAM), spin-torque transfer MRAM (STT-MRAM), flash memory, read-only memory (ROM), programmable read-only memory (PROM), erasable programmable read-only memory (EPROM), electrically erasable programmable read-only memory (EEPROM), registers, hard disk, a removable disk, or a compact disc read-only memory (CD-ROM). An exemplary memory device is coupled to the processor such that the processor can read information from, and write information to, the memory device. In the alternative, the memory device may be integral to the processor. The processor and the storage medium may reside in an application-specific integrated circuit (ASIC). The ASIC may reside in a computing device or a user terminal. In the alternative, the processor and the storage medium may reside as discrete components in a computing device or a user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein and is to be accorded the widest scope possible consistent with the principles and novel features as defined by the following claims.

What is claimed is:

1. A method comprising:

separating, at a device, an input audio signal into at least a low-band signal and a high-band signal, the low-band signal corresponding to a low-band frequency range and the high-band signal corresponding to a high-band frequency range;

determining a characteristic of the low-band signal;

selecting a non-linear processing function of a plurality of non-linear processing functions based on the characteristic;

generating a first extended signal based on the low-band signal and the non-linear processing function; and generating at least one adjustment parameter based on the first extended signal, the high-band signal, or both.

2. The method of claim 1, wherein the non-linear processing function is selected after the input audio signal is received at the device, wherein the first extended signal is generated by mixing a noise signal and a second extended signal, and wherein the at least one adjustment parameter is determined based on the first extended signal and the high-band signal.

3. The method of claim 2, wherein a first proportion of the noise signal and a second proportion of the second extended signal are mixed, and wherein the first proportion and the second proportion are determined based on a harmonicity of at least one of the low-band signal, the high-band signal, or the input audio signal.

4. The method of claim 3, further comprising determining the harmonicity based on an estimate of periodicity of the input audio signal in an audio frame, wherein the non-linear processing function is selected in response to receiving the input audio signal.

5. The method of claim 2, further comprising generating the second extended signal by filtering a third extended signal, wherein a bandwidth of the second extended signal corresponds to the high-band frequency range.

6. The method of claim 5, further comprising generating the third extended signal by applying the non-linear processing function to the low-band signal, wherein the non-linear processing function is selected on a frame by frame basis.

7. The method of claim 2, wherein the second extended signal is generated by applying a linear transformation to a third extended signal and selecting transform coefficients corresponding to the high-band frequency range.

8. The method of claim 7, wherein the non-linear processing function is selected by a function selector based on the characteristic of the low-band signal or a determined value of the characteristic of the low-band signal, and wherein the linear transformation corresponds to a discrete cosine transform.

9. The method of claim 1, further comprising selecting a first non-linear processing function of the plurality of non-linear processing functions in response to determining that the at least one adjustment parameter satisfies a first condition.

10. The method of claim 1, wherein the non-linear processing function is selected from among:

a first non-linear processing function of the plurality of non-linear processing functions that corresponds to a low order power function, and a second non-linear processing function of the plurality of non-linear processing functions that corresponds to a high order power function.

11. The method of claim 1, further comprising:

separating the input audio signal into at least the low-band signal and the high-band signal using analysis filter banks; and determining a parameter associated with a frame of the input audio signal, wherein the characteristic is an audio characteristic of the low-band signal, wherein the at least one adjustment parameter corresponds to at least one gain adjustment parameter associated with the high-band signal, and wherein the parameter associated with the frame comprises one of a coding mode chosen to encode the low-band signal, a periodicity of the frame, an amount of non-periodic noise in the frame, or a spectral tilt corresponding to the frame.

12. A method comprising:

receiving, at a device, low-band data corresponding to at least a low-band signal of an input audio signal;

decoding the low-band data to generate a synthesized low-band audio signal;

determining a characteristic of the low-band signal;

selecting a non-linear processing function of a plurality of non-linear processing functions based on the characteristic; and generating a synthesized high-band audio signal based on the synthesized low-band audio signal and the non-linear processing function.

13. The method of claim 12, further comprising generating an output audio signal by combining the synthesized low-band audio signal and the synthesized high-band audio signal, wherein the non-linear processing function is selected based on the synthesized low-band audio signal, and wherein a first bandwidth of the output audio signal is greater than a second bandwidth of the synthesized low-band audio signal.

14. The method of claim 12, further comprising generating a first extended signal by mixing a noise signal and a second extended signal, wherein the synthesized high-band audio signal is generated based on the first extended signal and at least one adjustment parameter, wherein a first proportion of the second extended signal and a second proportion of the noise signal are mixed, and wherein the first proportion and the second proportion are determined based on at least one of a received harmonicity parameter or the low-band data.

15. The method of claim 12, wherein the synthesized high-band audio signal is generated by scaling a first extended signal by a factor that is associated with at least one adjustment parameter.

16. The method of claim 12, further comprising generating a first extended signal based on a second extended signal and based on a third extended signal, wherein the second extended signal corresponds to a high-band frequency range.

17. The method of claim 12, further comprising generating a first extended signal based on a second extended signal, wherein the second extended signal is generated by:

applying a linear transformation to a third extended signal, the linear transformation corresponding to a discrete cosine transform, and the third extended signal based on the synthesized low-band audio signal and the non-linear processing function; and selecting transform coefficients corresponding to a high-band frequency range.

18. The method of claim 12, further comprising selecting the non-linear processing function based on a parameter received at the device on a frame by frame basis.

19. The method of claim 12, wherein the receiving, the decoding, the determining, the selecting, and the generating are performed within the device, and wherein the device comprises a mobile communication device.

20. The method of claim 12, wherein the receiving, the decoding, the determining, the selecting, and the generating are performed within a fixed location data unit.

21. An apparatus comprising:

a memory; and a processor configured to:

separate an input audio signal into at least a low-band signal and a high-band signal, the low-band signal corresponding to a low-band frequency range and the high-band signal corresponding to a high-band frequency range;

determine a characteristic of the low-band signal;

select a non-linear processing function of a plurality of non-linear processing functions based on the characteristic;

generate a first extended signal based on the low-band signal and the non-linear processing function; and generate at least one adjustment parameter based on the first extended signal, the high-band signal, or both.

22. The apparatus of claim 21, wherein the non-linear processing function is selected after the input audio signal is separated into at least the low-band signal and the high-band signal, wherein the first extended signal is generated by mixing a noise signal and a second extended signal, and wherein the at least one adjustment parameter is determined based on the first extended signal and the high-band signal.

23. The apparatus of claim 22, wherein a first proportion of the noise signal and a second proportion of the second extended signal are mixed, and wherein the first proportion and the second proportion are determined based on a harmonicity of at least one of the low-band signal, the high-band signal, or the input audio signal.

24. The apparatus of claim 23, wherein the processor is further configured to determine the harmonicity based on an estimate of periodicity of the input audio signal in an audio frame.

25. The apparatus of claim 22, wherein the processor is further configured to generate the second extended signal by filtering a third extended signal, and wherein a bandwidth of the second extended signal corresponds to the high-band frequency range.

26. The apparatus of claim 25, wherein the processor is further configured to generate the third extended signal by applying the non-linear processing function to the low-band signal.

27. The apparatus of claim 22, wherein the input audio signal is separated into at least the low-band signal and the high-band signal using analysis filter banks, and wherein the second extended signal is generated by applying a linear transformation to a third extended signal, the linear transformation corresponding to a discrete cosine transform, and selecting transform coefficients corresponding to the high-band frequency range.

28. The apparatus of claim 21, wherein the processor is further configured to determine a parameter associated with a frame of the input audio signal, wherein the non-linear processing function is selected based on the parameter, wherein a first non-linear processing function of the plurality of non-linear processing functions is selected in response to determining that the parameter satisfies a first condition, and wherein a second non-linear processing function of the plurality of non-linear processing functions is selected in response to determining that the parameter satisfies a second condition.

29. The apparatus of claim 28, wherein the parameter associated with the frame is one of a coding mode chosen to encode the low-band signal, a periodicity of the frame, an amount of non-periodic noise in the frame, and a spectral tilt corresponding to the frame.

30. The apparatus of claim 21, wherein the plurality of non-linear processing functions includes a low order power function and a high order power function, and wherein the at least one adjustment parameter corresponds to at least one gain adjustment parameter associated with the high-band signal.

31. The apparatus of claim 21, wherein the processor is integrated into an encoder system.

32. The apparatus of claim 21, further comprising:

an antenna; and a receiver coupled to the antenna and configured to receive a signal corresponding to the input audio signal.

33. The apparatus of claim 32, wherein the processor, the memory, the receiver, and the antenna are integrated into a mobile communication device.

34. The apparatus of claim 32, wherein the processor, the memory, the receiver, and the antenna are integrated into a fixed location data unit.

35. An apparatus comprising:

a memory; and a processor configured to:

receive low-band data corresponding to at least a low-band signal of an input audio signal;

decode the low-band data to generate a synthesized low-band audio signal;

determine a characteristic of the low-band signal;

select a non-linear processing function of a plurality of non-linear processing functions based on the characteristic; and generate a synthesized high-band audio signal based on the synthesized low-band audio signal and the non-linear processing function.

36. The apparatus of claim 35, wherein the processor is further configured to generate an output audio signal by combining the synthesized low-band audio signal and the synthesized high-band audio signal, and wherein a first bandwidth of the output audio signal is greater than a second bandwidth of the synthesized low-band audio signal.

37. The apparatus of claim 35, wherein the processor is further configured to generate a first extended signal by mixing a noise signal and a second extended signal, and wherein the synthesized high-band audio signal is generated based on the first extended signal and at least one adjustment parameter.

38. The apparatus of claim 37, wherein a first proportion of the second extended signal and a second proportion of the noise signal are mixed, and wherein the first proportion and the second proportion are determined based on at least one of a received harmonicity parameter or the low-band data.

39. The apparatus of claim 37, wherein the synthesized high-band audio signal is generated by scaling the first extended signal by a factor associated with the at least one adjustment parameter.

40. The apparatus of claim 37, wherein the processor is further configured to generate the second extended signal by filtering a third extended signal, and wherein the second extended signal corresponds to a high-band frequency range.

41. The apparatus of claim 37, wherein the second extended signal is generated by applying a linear transformation to a third extended signal and selecting transform coefficients corresponding to a high-band frequency range.

42. The apparatus of claim 41, wherein the linear transformation corresponds to a discrete cosine transform.

43. The apparatus of claim 41, wherein the processor is further configured to generate the third extended signal based on the synthesized low-band audio signal and the non-linear processing function.

44. The apparatus of claim 35, wherein the processor is further configured to select the non-linear processing function based on a received parameter or the low-band data.

45. The apparatus of claim 35, wherein the processor is integrated into a mobile device that includes a decoder system.

46. An apparatus comprising:

means for separating an input audio signal into at least a low-band signal and a high-band signal, the low-band signal corresponding to a low-band frequency range and the high-band signal corresponding to a high-band frequency range;

means for determining a characteristic of the low-band signal;

means for selecting a non-linear processing function of a plurality of non-linear processing functions based on the characteristic;

first means for generating a first extended signal based on the low-band signal and the non-linear processing function; and second means for generating at least one adjustment parameter based on the first extended signal, the high-band signal, or both.

47. The apparatus of claim 46, wherein the means for selecting is configured to select the non-linear processing function after the input audio signal is received at the means for separating, wherein the first extended signal is generated by mixing a noise signal and a second extended signal, and wherein the at least one adjustment parameter is determined based on the first extended signal and the high-band signal.

48. The apparatus of claim 47, wherein a first proportion of the noise signal and a second proportion of the second extended signal are mixed, and wherein the first proportion and the second proportion are determined based on a harmonicity of at least one of the low-band signal, the high-band signal, or the input audio signal.

49. The apparatus of claim 46, wherein the means for determining, the means for selecting, the first means for generating, and the second means for generating are integrated into a mobile device.

50. An apparatus comprising:

means for receiving low-band data corresponding to at least a low-band signal of an input audio signal;

means for decoding the low-band data to generate a synthesized low-band audio signal;

means for determining a characteristic of the low-band signal;

means for selecting a non-linear processing function of a plurality of non-linear processing functions based on the characteristic; and means for generating a synthesized high-band audio signal based on the synthesized low-band audio signal and the non-linear processing function.

51. The apparatus of claim 50, wherein the low-band data indicates characteristics of the low-band signal.

52. The apparatus of claim 50, wherein the synthesized high-band audio signal is generated by scaling a first extended signal by a factor that is associated with at least one adjustment parameter.

53. The apparatus of claim 50, wherein the means for determining, the means for selecting, and the means for generating are integrated into a communication mobile device.

54. The apparatus of claim 50, wherein the means for determining, the means for selecting, and the means for generating are integrated into a fixed location data unit.

55. A computer-readable storage device storing instructions that, when executed by a processor, cause the processor to perform operations comprising:

separating an input audio signal into at least a low-band signal and a high-band signal, the low-band signal corresponding to a low-band frequency range and the high-band signal corresponding to a high-band frequency range;

determining a characteristic of the low-band signal;

selecting a non-linear processing function of a plurality of non-linear processing functions based on the characteristic;

generating a first extended signal based on the low-band signal and the non-linear processing function; and generating at least one adjustment parameter based on the first extended signal, the high-band signal, or both.

56. The computer-readable storage device of claim 55, wherein the non-linear processing function is selected after the input audio signal is separated into at least the low-band signal and the high-band signal, wherein the first extended signal is generated by mixing a noise signal and a second extended signal, and wherein the at least one adjustment parameter is determined based on the first extended signal and the high-band signal.

57. The computer-readable storage device of claim 56, wherein the operations further comprise:

generating the second extended signal by filtering a third extended signal, wherein a bandwidth of the second extended signal corresponds to the high-band frequency range; and generating the third extended signal by applying the non-linear processing function to the low-band signal.

58. A computer-readable storage devices storing instructions that, when executed by a processor, cause the processor to perform operations comprising:

receiving low-band data corresponding to at least a low-band signal of an input audio signal;

decoding the low-band data to generate a synthesized low-band audio signal;

determining a characteristic of the low-band signal;

selecting a non-linear processing function of a plurality of non-linear processing functions based on the characteristic; and generating a synthesized high-band audio signal based on the synthesized low-band audio signal and the non-linear processing function.

59. The computer-readable storage device of claim 58, wherein the operations further comprise determining a parameter associated with a frame of the input audio signal, and wherein the non-linear processing function is selected based on the parameter.

* * * * *